United States Patent [19]

Smith

[11] 4,235,382

[45] Nov. 25, 1980

[54] METHOD AND APPARATUS FOR RECHIPPING WOOD CHIPS

[75] Inventor: William C. Smith, West Vancouver, Canada

[73] Assignee: Rader Companies Inc., Portland, Oreg.

[21] Appl. No.: 15,125

[22] Filed: Feb. 26, 1979

[51] Int. Cl.[3] ..... B02C 18/14

[52] U.S. Cl. ..... 241/28; 241/85; 241/86; 241/229; 241/72

[58] Field of Search ..... 241/28, 85, 86.1, 88.1, 241/93, 228, 229, 251, 86; 144/163, 174

[56] References Cited

U.S. PATENT DOCUMENTS

| | | | |
|---|---|---|---|
| 2,637,359 | 5/1953 | Taylor | 241/85 |
| 2,710,635 | 6/1955 | Alexander | 241/93 X |
| 2,874,909 | 2/1959 | Pallmann | 241/93 X |

*Primary Examiner*—Mark Rosenbaum

*Attorney, Agent, or Firm*—Dirk J. Veneman; Michael L. Gill; Gerald A. Mathews

[57] ABSTRACT

A wood chip rechipping method and apparatus are provided wherein a slotted, cylindrical drum rotates about a concentrically mounted rotatable anvil rotor having a plurality of arms, each of which has a blade at its outer extremity. The drum and anvil rotor arms rotate in the same direction, but at different speeds. The rotating apparatus induces centrifugal force on the wood chips to position them against the inner periphery of the drum where the blades on the relatively faster rotating anvil arms shear off a chip slice having a predetermined thickness. This shearing action continues until each chip has been rechipped into slices capable of passing through one of the drum knife slots and into the discharge outlet.

6 Claims, 5 Drawing Figures

METHOD AND APPARATUS FOR RECHIPPING WOOD CHIPS

BACKGROUND OF THE INVENTION

This invention relates to apparatus for chipping wood chips used to make pulp which in turn is used in paper-making machines to make paper and paperboard products. More particularly, this invention relates to apparatus for receiving oversize wood chips and rechipping them into chips having acceptable (i.e. thinner) thickness, but substantially the same length and width.

In the paper industry, wood pulp is made by subjecting wood chips to a chemical process wherein the compounds and chemical systems holding the fibers together, such as lignin, to form the chip are dissolved to thereby liberate the individual wood fibers which are then diluted with water and introduced into a paper-making machine to make the paper or paperboard products. If the wood chips introduced into the refiners in which the chemical fiber liberating process takes place are not of a relatively uniform thickness, within predetermined limits, some chips might not be penetrated by the chemicals at all, or not penetrated for a time sufficient to liberate all the wood fibers. Other chips, if they are too thin, might be exposed to the fiber liberating chemicals for a time longer than necessary to merely liberate the individual fibers whereupon the fibers themselves would be deleteriously weakened, or shortened, or both. Thus, it is very important that the thickness of the chips sent into the pulping digester be uniform within specified limits determined by the kind of wood and desired pulp parameters. Since the chipping equipment operates against the external surface of the logs being chipped, it is relatively easy to control the chip length which coextends substantially with the wood grain along the surface of the generally cylindrical log.

However, the thickness of the individual wood chips is in the direction extending radially inwardly to the center of the log. In other words, the chip thickness might generally be described as extending in a direction normal to an imaginary plane tangent with the generally cylindrical surface of the log periphery. The thickness of the chips produced is therefore more difficult to contol since they sometimes are gouged or broken out in chunks. The chips produced by the chipping apparatus are screened and classified. Oversized chips, sometimes called "cards" in the industry, have heretofore been sent to one of several types of known rechippers. For example, a so-called disk-type rechipper operates by rotating a disk containing a plurality of blades in its face against a stationary bed knife. Gravity fed chips are discharged upwardly under the impetus of the rotating disk blades.

Other types of known rechippers include the rigid-hammer type shredder which utilizes a punch and die type of action wherein teeth mounted on a rotating shaft rotate through slots in stationary anvils. The swing-hammer type shredder utilizes a plurality of pivotally mounted hammers which rotate and force chips through a grid-like breaker plate.

All of these prior types of rechippers/shredders have a common characteristic in that their knives, blades and hammers engage the chips in a random manner which results in the chips being cut, broken and pulverized so that the smaller chips produced have undesirable shorter lengths as well as thinner thickness. A great deal of undesirable fines (i.e. dust and very small chips and pieces) are produced as well.

Operators of these prior types of rechippers attempted to improve the quality of chips produced by the rechippers by feeding them only the very largest chips screened from the chippers, which may be 10% of the output, but this has the concomitant effect of reducing the effective output of the chippers.

SUMMARY OF THE INVENTION

This invention obviates the deficiencies and problems associated with prior rechipping apparatus by reducing the amount of chips which are disintegrated, shortened, crushed or otherwise reduced to unacceptable fines. This is achieved by providing an anvil rotor having a plurality of rotor arms to rotate concentrically within a rotating, substantially cylindrical segmented drum. The tips of the rotor arms are equipped with an anvil blade which cooperates with the different number of knives mounted to a corresponding number of arcuate segments of the segmented cylindrical drum. Both the rotor arms and the drum rotate in the same direction, but at different speeds, with the anvil rotor arms rotating at a greater speed than the drum.

The oversize wood chips are introduced near the center of rotation and are positioned and orientated against the inner periphery of the drum wall by centrifugal force where the faster rotating blades on the anvil rotor arms encounter them and move them to the next drum knife in the direction of rotation where the relative movement of the blade and knife take a slice of the chip for removal from the rechipping apparatus. Each chip is pushed along the inner periphery of the segmented drum until it has been sliced by a sufficient number of subsequent drum knives to pass entirely through the drum for discharge.

The chipping process produces chips, oversized or otherwise, having a length greater than their width or thickness. This invention exploits this fact by subjecting the chips to centrifugal force which acts through their center of gravity. This force then causes a chip to rotate about a short side edge to thereby orientate the chip with its long side against the drum wall. This results in the subsequent slices being made in the same general plane as the length dimension so that each subsequently sliced chip has most of its wood fibers extending in the length direction. This helps ensure that the fibers liberated in the chemical pulping process will tend to be long, which is the desired result.

The orientation of the oversize chips on the drum segments also results in the production of less fines because the chips are cut substantially lengthwise which tends to produce whole slices having the desired length to produce quality pulp fibers rather than slices which have been taken across the grain which necessarily shortens the chip slice and the fibers that can be subsequently produced.

By making the number of drum knives different from the number of blades on the anvil rotor arms, the frequency and timing of the impacts of the chips between the anvil blades and drum knives is randomly staggered about the drum circumference so that the shock loading on the drum and anvil rotor shafts are smaller and more evenly distributed to provide more uniform and smooth operation. It is preferred that the number of drum knives exceed the number of anvil rotor blades because of the slightly greater circumferential distance around the inner periphery of the segmented drum compared to the path traced by the tips of the anvil rotor blades, and also to allow for chip slices to be removed quickly before they can interfere with other chips and possibly contribute to the production of fines, smaller chip slices and the like.

Accordingly, it is an object of this invention to provide a wood chip rechipper which utilizes centrifugal force to orientate and position the chips against the drum wall to be rechipped into smaller chip slices.

Another object of this invention is to provide a wood chip rechipper which utilizes a rotating drum and a rotating rotor which both rotate in the same direction, but at different speeds to effect the cutting action between the drum knives and anvil rotor arm blades.

Still another object of this invention is to provide a wood chip rechipping apparatus wherein the oversize chips fed into the rechipper are reduced in size primarily by their thickness.

Yet another object of the invention is to provide a wood chip rechipping apparatus which reduces the amount of chips which are disintegrated or reduced to undesirable fines.

Another object of this invention is to provide a wood chip rechipping apparatus wherein the chips fed into it are orientated so that subsequent slices of the chips are taken substantially along the grain of the chip to produce small chip slices having substantially the same length as the chip from which this slice is made.

A feature of this invention is that the waste produced from the chips fed into it is less than about 8%.

Another feature of this invention is the use of a different number of rotor arm blades and drum knives.

These and other objects, features and advantages of the invention will become readily apparent to those skilled in the art when the following description of the preferred embodiment is read in conjunction with the attached drawings.

DESCRIPTION OF THE PREFERRED EMBODIMENT

Figure 1:
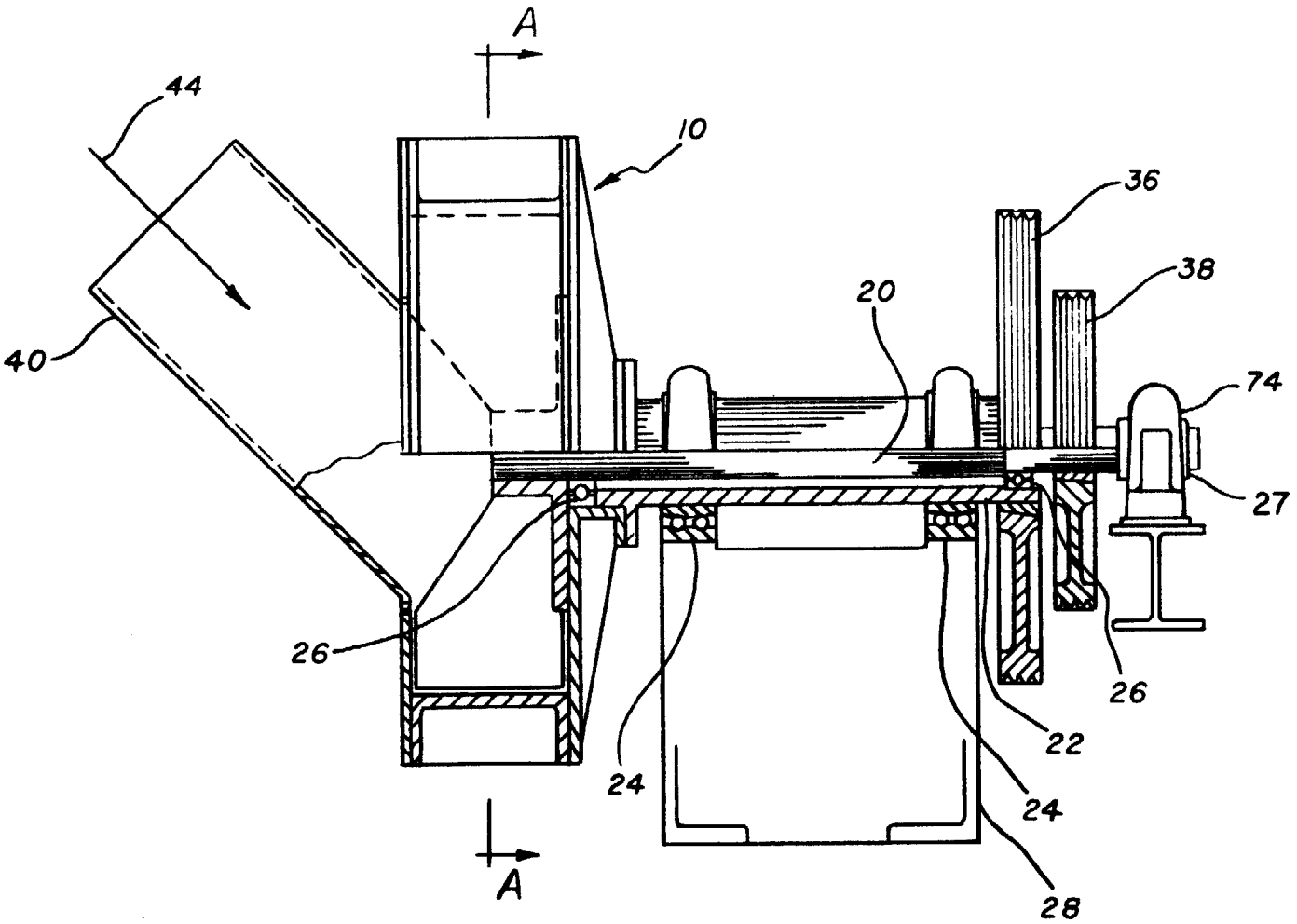
FIG. 1 is a side elevational view, partially in section, of the rechipping apparatus.
Figure 2:
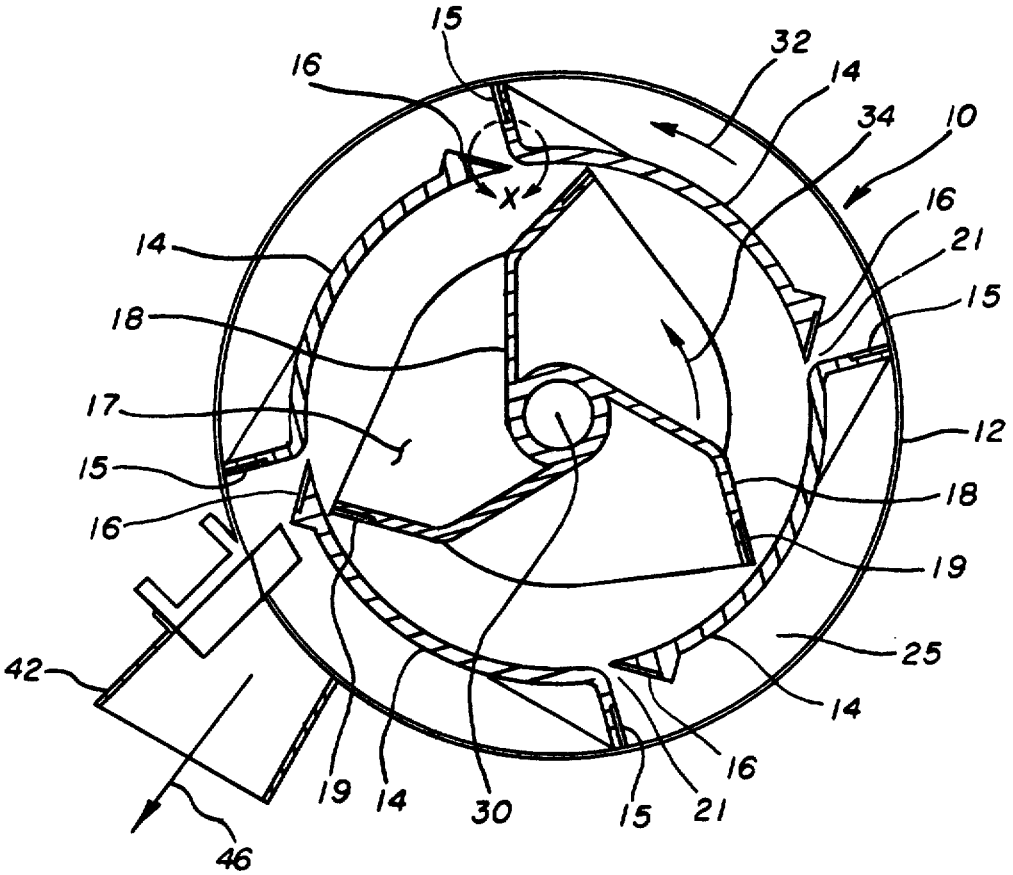
FIG. 2 is an end view through section A—A of the apparatus shown in FIG. 1.

As shown in FIGS. 1 and 2, a wood chip rechipper, designated generally as item 10, has a cylindrical drum 14 secured to one end of a drum shaft 22. A drum shaft sheave 36 is secured to the other end of drum shaft 22 to provide rotary motion in the direction of arrow 32. An anvil 17 having three equally spaced rotor arms 18 is mounted to one end of an anvil shaft 20. An anvil shaft sheave 38 is secured to the other end of anvil shaft 20 to provide rotary motion in the direction of arrow 34 which is the same direction as arrow 32. Drum shaft 22 is rotatably mounted in a pair of axially spaced bearings 24 and anvil shaft 20 is mounted in a pair of axially spaced bearings 26 on support stand 28 to rotate concentrically with one another about axis 30.

As shown in FIG. 2, cylindrical drum 14 is divided into four arcuate, substantially identical segments, each of which is spaced from the adjacent segment to form a corresponding plurality of slots 21 extending longitudinally along the length of the cylindrical drum 14 in the direction of the axis of rotation 30.

Figure 3:
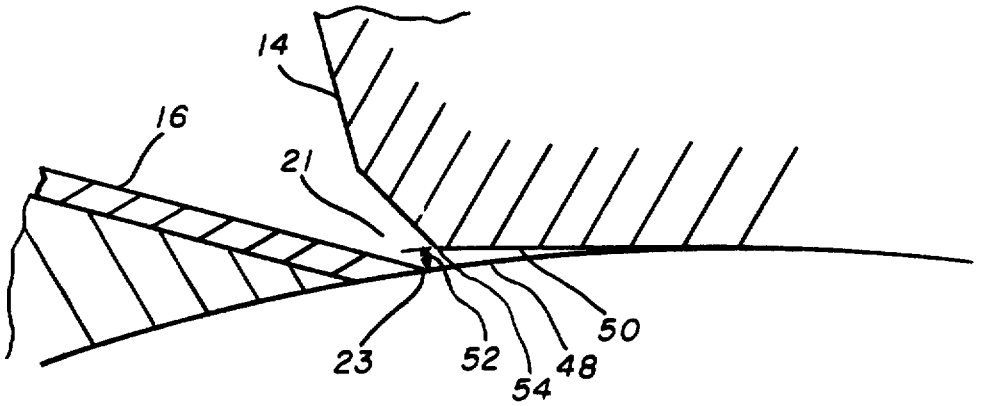
FIG. 3 is an enlarged view of the circled portion of the apparatus shown in FIG. 2 which illustrates the relieved portion typical of each drum segment and its relation to the drum knife so as to produce a chip slice of the desired thickness.
Figure 4:
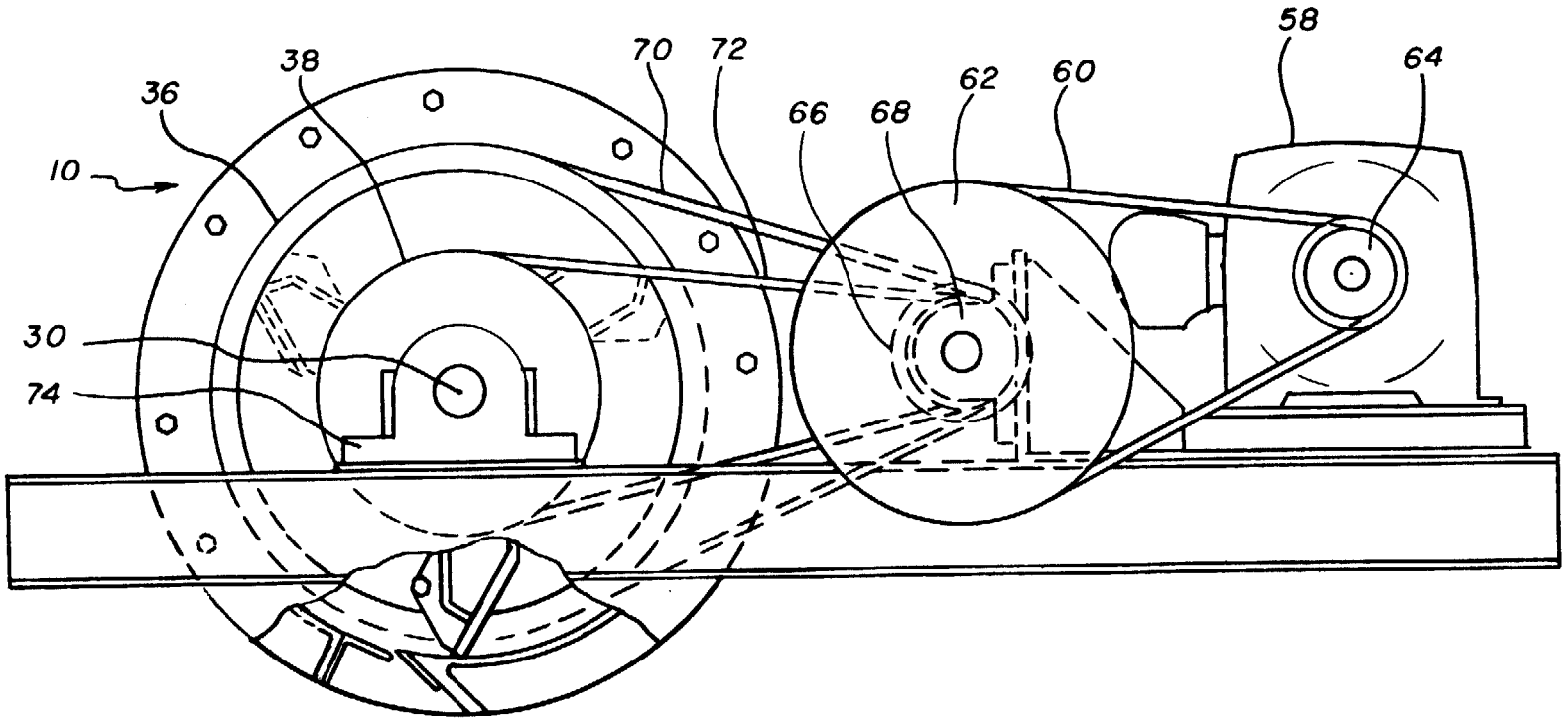
FIG. 4 is an end view of the other end of the rechipping apparatus showing the manner in which a motor provides power and rotary motion to the drum and anvil rotor.
Figure 5:
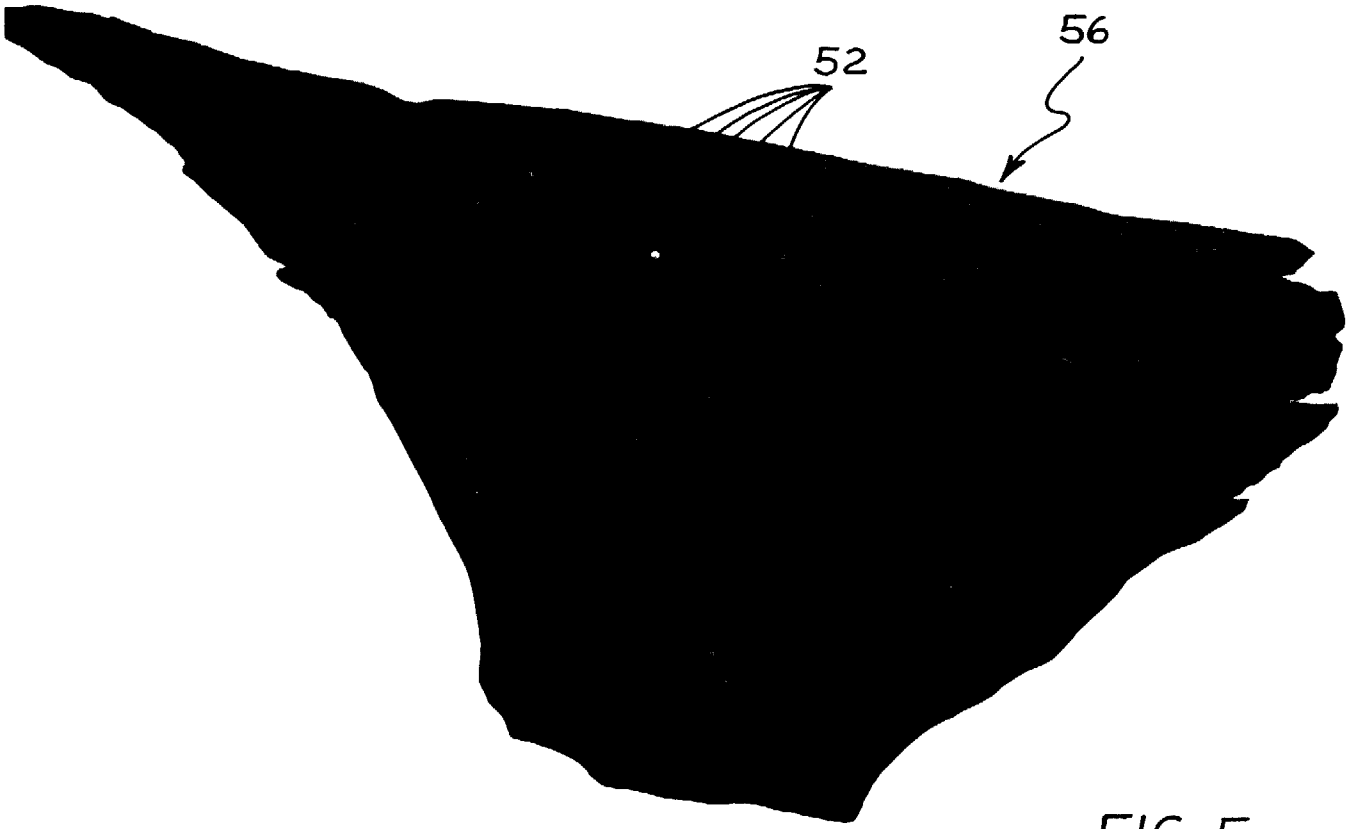
FIG. 5 is a picture of a typical oversized wood chip which would be fed into the rechipping apparatus and which shows how the chip is sliced to produce a plurality of slices having their length dimension extending generally in the direction of the wood grain.

Anvil rotor 17 is shown having three rotor arms 18 on the ends of each of which are mounted an anvil blade 19. On one end of each segment of drum 14, a drum knife 16 is mounted to form one side of slot 21. The inner peripheral surface of each segment of drum 14 is relieved in a direction radially outward from axis 30 to form a relief surface 50 having an edge 54, as shown in FIG. 3, which cooperates with the drum knife edge 23 to define the thickness 52 of the chip slices produced. The line 48 traces the circular path of travel of the tip edges 23 of drum blades 16.

The rechipper is rotatably driven by a motor 58 which has a drive hub 64 linked with a drive sheave 62 by one or more drive belts 60. Drive sheave 62 in turn is secured to a shaft on which a small drum sheave 66 and small anvil sheave 68 are secured and which receive corresponding drum and anvil drive belts 70, 72, respectively, which wrap the anvil shaft sheave 38 and drum shaft sheave 36 to provide rotary power to the rechipper. The anvil rotor shaft has outer bearings 27 secured in pillow blocks 74, one of which is not shown in FIG. 1 for clarity. The manner in which drive motor 58 supplies power to the rechipping apparatus through the sheaves and belts, and the manner in which the shafts are rotatably mounted, are not considered unique in and of themselves and therefore will not be described in any further detail. Other means for supplying rotary power to the anvil rotor and drum in the same direction can readily be perceived and designed by the person skilled in the art.

In operation, a stream of oversize wood chips is fed into the rechipper 10 through an inlet 40 in the direction of arrow 44. Through the sizing of sheaves 36 and 38, motor 58 rotates arm 18 of anvil 17 and drum 14 in the same direction, but at different speeds. The anvil arms are rotated at a faster speed than the drum and representative speeds of the anvil rotor would be about 150–200 rpm and about 100–150 rpm for the drum. Clearly, many factors enter into the determination of the best speeds for a given situation, and the preceeding ranges are intended to be expositive, not the slowest and fastest limits. For example, such factors would include the size and density of the chips, the rate at which the chips were being fed into the rechipper, the diameter of the drum, the number of anvil arms and drum blades, and the power of the motor. In a rechipper having a drum inner diameter of 36 inches, it has been found that an anvil rotor having three arms rotating at 150 rpm and operating in conjunction with a drum having four equally spaced drum knives rotating at 100 rpm is an example of a combination of dimensions and operating parameters which produce satisfactory results.

As the chips enter the rechipper near the center of the axis rotation 30, they are urged by centrifugal force against the inner walls of the segments forming the generally cylindrical drum 14.

The size of the individual oversize chips will, of course, vary greatly depending on the type of wood, the pulping process to be used and the screening size being used to determine what constitutes an oversize chip. Generally, a chip has a long side extending in the direction of the wood grain, a width which might range from about ¼ to ½ of the length, and a thickness of about ¼–½ inch. An example would be a chip about 2 inches long, ½–1 inch wide and ⅜ of an inch thick. For this invention, oversize oversize chips are essentially thicker chips and might be 2–3 inches long, 1–2 inches wide and ¾–1 inch thick.

Tabulated below are the results of three typical samples showing the distribution of rechipped chips, according to size, made from a supply constituting 100% oversize chips fed into the rechipper of this invention.

| Chip Size (Inches) | | % | | |
|---|---|---|---|---|
| Smaller Than | Larger Than | Sample I | Sample II | Sample III |
| | +¾ | 27.3 | 20.3 | 27.7 |
| −¾ | +½ | 24.4 | 29.0 | 26.6 |
| −½ | +⅜ | 19.4 | 18.5 | 16.9 |
| −⅜ | +¼ | 14.4 | 16.4 | 15.3 |
| −¼ | +3/16 | 6.2 | 6.3 | 7.6 |
| −3/16* | | 8.3 | 9.4 | 5.9 |
| | | 100 | 99.9 | 100 |

*Average − 3/16 = 6.8%

Once the chips are under the influence of the centrifugal forces induced by the rotation of the drum, they naturally tend to become orientated against the inner surface of the drum with their long sides flat against the drum wall in the manner described in the Summary of the Invention. Since both the length and width sides of the chip extend in the direction of the wood grain, the chips are thus orientated and positioned on the drum wall so that the oncoming relatively moving blades on the anvil rotor arms encounter the chips with their blade edges substantially parallel with the grain of the wood chip and urge the chip along the wall and against the next oncoming drum knife. As the chip nears the proximity of the drum knife, it encounters a relief 50 in the segment of the drum wall. The relief tapers radially outwardly from the axis of rotation and ends in an edge which is of a predetermined distance from the circular path 48 described by the motion of the edges 23 of the drum knives. This distance 52 is typically set at about ¼ inch.

The relative motion of the anvil blade over the drum knife causes a slice to be made through the chip substantially along the grain of the wood to produce a chip slice, or smaller new chip, having a length and width about the same as the oversize chip, but having a thickness equal to the preset distance 52, or about ¼ inch, for example. The rotating anvil arms continue to move each chip along the inner wall of the drum to encounter each of the drum knives which each take another cut of predetermined thickness until the entire chip has passed the drum knives and into the outer cylindrical chamber 25 between the drum 14 and outer housing 12. There, the chips are urged by a plurality of drum wiper blades 15, corresponding to the number of drum segments around the drum chamber until they reach the chip discharge chute 42 where they are discharged from the rechipper in the direction of arrow 46.

Thus, a rechipper has been provided which operates to rechip wood chips efficiently without pulverizing, disintegrating or otherwise destroying a significant portion of the chips in the process. For example, some prior art rechippers would produce up to 30%–50% fines whereas this rechipper will usually produce less than about 8%–9% fines, depending on various operating parameters and the definition of a "fine". Here, a fine is considered to be anything that will pass a 3/16 inch screen.

It is also contemplated that other combinations of numbers of anvil arm blades and drum knives can be used. For example, four drum knives could be used in conjunction with two or five anvil rotor arms/blades. Similarly, five drum knives could be used in conjunction with two, three or four anvil rotor arms/blades. The preferred combination is to have more drum knives than anvil rotor arms/blades, and the most preferred combination is to have three rotor arms/blades and four drum knives. The important criterion is that the number of drum blades and anvil rotor arms/blades be different. However, it is contemplated that some means could be used, such as staggering the distances between drum knives unevenly, so that a like number of drum knives and rotor arm blades could be used without having two or more pairs of blades/knives coming into contact at the same time to produce excessively high impact forces on the motor and drive train. These and other slight modifications and changes, which would be readily discernible to one skilled in the art, are intended to be within the spirit and scope of the appended claims.

What is claimed is:

1. Apparatus for rechipping oversize wood chips into smaller chips comprising, in combination:

a cylindrical drum adapted to be rotated about its longitudinal axis and having (a) a wall comprising a plurality of segments defining a corresponding plurality of slots in the wall, said slots extending substantially longitudinally along the drum wall, (b) a plurality of knives, each knife being mounted in a wall segment;

means for introducing oversize chips into the drum;

an anvil rotor having a plurality of arms on each of which a corresponding blade is mounted, said anvil rotor adapted to be rotated concentrically within the drum;

means for rotating the anvil rotor and drum in the same direction at different rotational speeds with the rotor arm speed being greater than the drum speed, whereby oversize chips are positioned and orientated against the drum inner wall by centrifugal force where they are engaged by the anvil rotor arm blades and moved along the wall to the next drum knife where the relative movement of the blade pushing the chip past the knife cuts a slice from a chip to pass through a slot for discharge from the rechipping apparatus.

2. The apparatus as set forth in claim 1, wherein:

the number of drum knives and rotor arm blades are different.

3. The apparatus as set forth in claim 1, wherein:

the number of drum knives exceeds the number of rotor arms and corresponding blades.

4. The apparatus as set forth in claim 3, wherein:

the drum includes four wall segments and corresponding knives;

the anvil rotor includes three arms and corresponding blades so that in operation, only one knife and blade will be slicing chips at any one time.

5. A method for rechipping oversize wood chips into smaller chips which utilizes a cylindrical drum having a longitudinal axis and a plurality of knives mounted in the drum wall which coextend substantially with the longitudinal axis, said oversize chips generally having a length greater than their thickness, comprising the steps of:

(1) introducing oversize chips into the cylindrical drum;

(2) rotating the drum about its longitudinal axis to induce centrifugal force on the oversize chips to position them against the inner wall of the drum and orientate them substantially with their thickness dimension extending inwardly substantially toward the longitudinal axis of rotation;

(3) rotating a blade within the drum concentrically about the longitudinal axis and in proximity with the knives, and in the same direction as the drum rotation but at a different speed than the drum, whereby the blade contacts the oversize chips on the drum inner wall and moves the chips along the wall to engage a drum knife to take a slice from the chips;

(4) removing the smaller chip slices taken from the oversize chips.

6. The method as set forth in claim 5, wherein: the blade is rotated at a faster speed than the drum.

* * * * *